US006564794B1

(12) United States Patent
Zia et al.

(10) Patent No.: US 6,564,794 B1
(45) Date of Patent: May 20, 2003

(54) HEAT EXCHANGER AIR BAFFLE DIVERTER VANE

(75) Inventors: Ninev Karl Zia, Indianapolis, IN (US); Merle Dana Sears, Mooresville, IN (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/038,441

(22) Filed: Jan. 7, 2002

(51) Int. Cl.[7] ..... F24H 3/00; F28F 3/14; F28D 7/00

(52) U.S. Cl. ..... 126/110 R; 126/99 D; 165/170; 165/159

(58) Field of Search ..... 126/110 R, 99 D; 165/170, 159, 401

(56) References Cited

U.S. PATENT DOCUMENTS 4,147,153 A * 4/1979 Buckner ..... 126/521
4,185,610 A * 1/1980 Buckner ..... 126/521
4,651,711 A * 3/1987 Velie ..... 126/110 C
5,333,597 A * 8/1994 Kirkpatrick et al. .... 126/110 R
5,370,529 A * 12/1994 Lu et al. ..... 431/353
5,448,986 A * 9/1995 Christopher et al. .... 126/110 R

* cited by examiner

*Primary Examiner*—Henry Bennett
*Assistant Examiner*—Alfred Basichas

(57) ABSTRACT

In a furnace having a plurality of parallel heat exchanger panels over which circulation air is caused to flow, and which has a tendency for hot spots to occur at particular locations on its outboard heat exchanger panels, a diverter vane is placed on the outer side of each of the outboard heat exchanger panels to divert a portion of the circulation air to the hotspot locations for cooling them to acceptable temperatures. In one form, the diverter vane is integrally formed with, and extends normally inwardly from a side baffle that extends upwardly alongside the outboard heat exchanger panel. The diverter vane is obliquely disposed with respect to the side baffle, with its lower end located near a midpoint of the heat exchanger panel and its upper end located near the hotspot location. When used with a multipass heat exchanger panel, the hotspot location is between the end of the first return bend and the commencement of the second pass, and the diverter vane is thus positioned with its top end near that location. Where a blower shelf baffle is employed, the diverter vane lower end is positioned near that location.

16 Claims, 4 Drawing Sheets

HEAT EXCHANGER AIR BAFFLE DIVERTER VANE

BACKGROUND OF THE INVENTION

This invention relates generally to furnaces and, more particularly, to an air baffle diverter vane for diverting air over a particular portion of a furnace heat exchanger for preventing hot spots.

Residential furnaces typically include a plurality of heat exchanger panels or cells arranged in parallel relationship, with the air to be heated being circulated by a blower so as to pass between the panels and over the surfaces of the panels, to be heated. The panels have associated burners for heating the air within the panels, and an inducer may be employed to draw the heated air through the panels and discharge them to a flu.

One form of heat exchanger that is commonly used in such furnaces is a so-called clamshell heat exchanger, wherein two stamped metal shells are fastened together to form a single panel having a plurality of serpentine passages, or passes, through which the hot gases can be caused to flow. Thus, a burner heats the air at an inlet end thereof, and the hot gases pass through successive passes and finally come out of the exit end of the panel to eventually be discharged to the flu. As the gases pass from the inlet to the exit end of the panel, they are cooled by the air being circulated over the surface of the panel. Thus, the gases in the first pass are at substantially higher temperatures than those downstream thereof, and care must be taken to prevent the occurrence of excessive temperatures. In particular, hot spots are most likely to occur in the vicinity of the first return bend between the first and second passes. These hot spots cause exposure to high temperatures that can cause excessive strain levels in the material of the heat exchanger structure and may eventually lead to failure.

Typically, the peak temperatures on the outside of the outboard heat exchanger panels are higher than the temperature on the inboard heat exchanger panels. In an effort to obtain greater circulation airflow over the outer sides of these outboard heat exchanger panels, so-called sidewall baffles have been applied to better channel the circulation airflow along the outer surfaces of the outdoor panels. Such sidewall baffles are generally fastened to the furnace casing or to the blower shelf and extend substantially vertically upwardly in parallel relationship with its associated outboard heat exchanger panel. While these sidewall baffles are useful in improving the air circulation over the outboard panels and thereby preventing excessive temperatures in this area, they may not be sufficient to prevent hot spots, especially in the sensitive area of the first return bend.

It is therefore an object of the present invention to provide an improved furnace heat exchanger apparatus.

Another object of the present invention is to provide a heat exchanger apparatus with reduced thermal stress.

Yet another object of the present invention is the provision for maintaining the temperatures on the surface of an outboard heat exchanger panel within acceptable limits.

Still another object of the present invention is the provision in heat exchanger apparatus for lowering both the peak temperatures on the surface of an outboard heat exchanger.

Another object of the present invention is the provision in a heat exchanger apparatus for reducing the occurrence of hot spots in the first return bend of an outboard heat exchanger panel.

These objects and other features and advantages become more readily apparent on reference to the following descriptions when taken in conjunction with the appended drawings.

SUMMARY OF THE INVENTION

Briefly, in accordance with one aspect of the invention, a diverter vane is added to the inboard side of a sidewall baffle and extends inwardly toward an outboard heat exchanger panel so as to divert a portion of the circulation airflow to particular areas on the heat exchanger panel surface which might otherwise experience hot spots.

In accordance with another aspect of the invention, the diverter vane is permanently affixed to and extends substantially normally from said sidewall baffle.

In accordance with yet another aspect of the invention, the diverter vane is disposed at an oblique angle with respect to the heat exchanger passes, with its lower end being located near a central point of said first pass and its upper end being located near the end of said first return bend.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
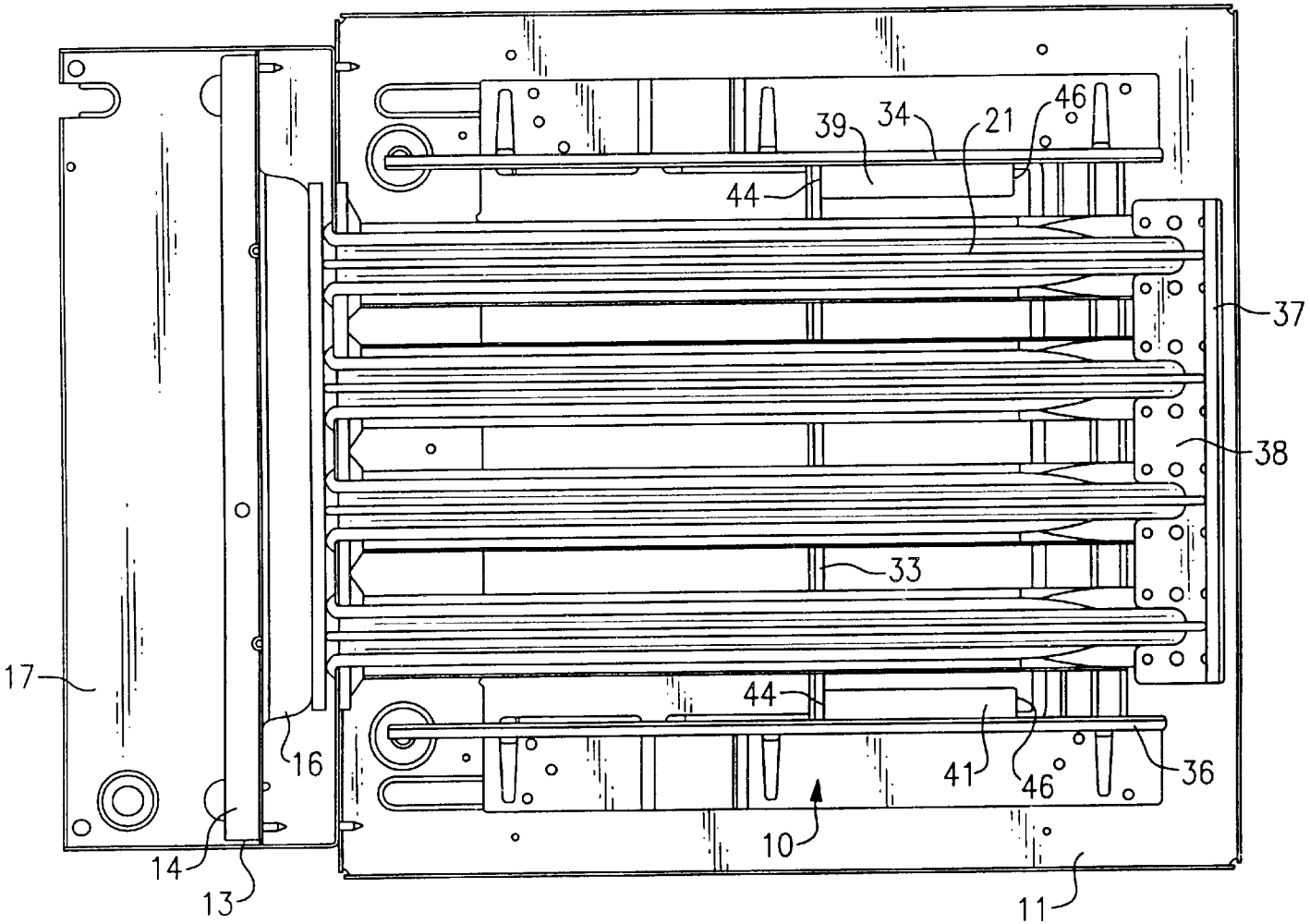
FIG. 1 is a top view of a heat exchanger assembly and diverter vanes as installed in a furnace in accordance with the present invention.
Figure 2:
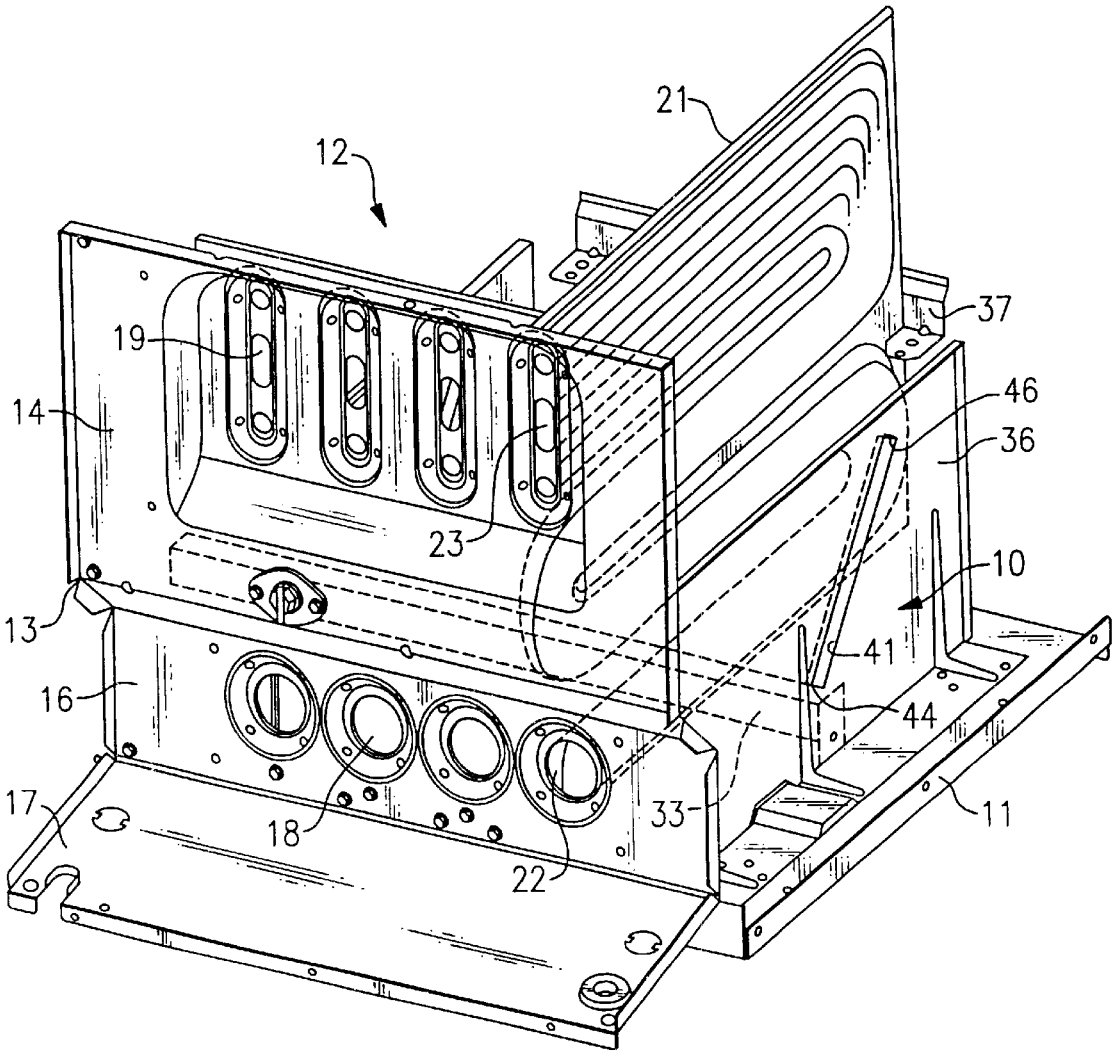
FIG. 2 is a perspective view of a heat exchanger panel and a diverter vane as installed in a furnace in accordance with the present invention.

Referring to FIGS. 1 and 2, the invention is shown generally at 10 as applied to a furnace having a blower shelf 11 which defines the boundary between a blower compartment therebelow and a heat exchanger compartment 12 thereabove.

Attached to the blower shelf 11 is a cell panel 13 which extends upwardly and forwardly as shown and includes the integrally connected upper panel 14, middle panel 16, and front panel 17. The front panel 17 defines the boundary between the circulating air below and the combustion air above. The middle panel 16 has a plurality of burner openings 18 formed therein for receiving individual burners (not shown) that extend therethrough in a conventional manner. A gas manifold (not shown) provides gas to the individual burners, and combustion air is provided to those burners, with the gas/air mixture then being ignited to provide hot gases for producing heat.

The upper panel 14 includes a plurality of spaced outlet openings 19 from which the hot gases are discharged after passing through the heat exchanger compartment 12. A collector box (not shown) provides a common cover over the outlet openings 19 and is attached to an inducer (not shown) which acts in a conventional manner to draw the combustion gases from the burner openings 18, through the heat exchanger compartment 12 and through the outlet openings 19 for eventual discharge to a flu.

Behind the cell panel 13, and within the heat exchanger compartment 12, there are provided a plurality of heat exchanger panels 21 that are arranged in a side-by-side, parallel relationship and extending upwardly as shown. Each of the heat exchanger panels 21 has an inlet opening 22 and an outlet opening 23, with the inlet opening 22 being in registration with a corresponding burner opening 18 and with the outlet opening 23 being in registration with a corresponding outlet opening 19 of the upper panel 14. Each of the heat exchanger panels 21 is fastened near its outlet opening 23 to the upper panel 14 and near its inlet opening 22 to the middle panel 16. Thus each of the heat exchanger panels 21 is completely supported by the cell panel 13, which in turn is supported by the blower shelf 11 and the furnace casing.

Figure 3:
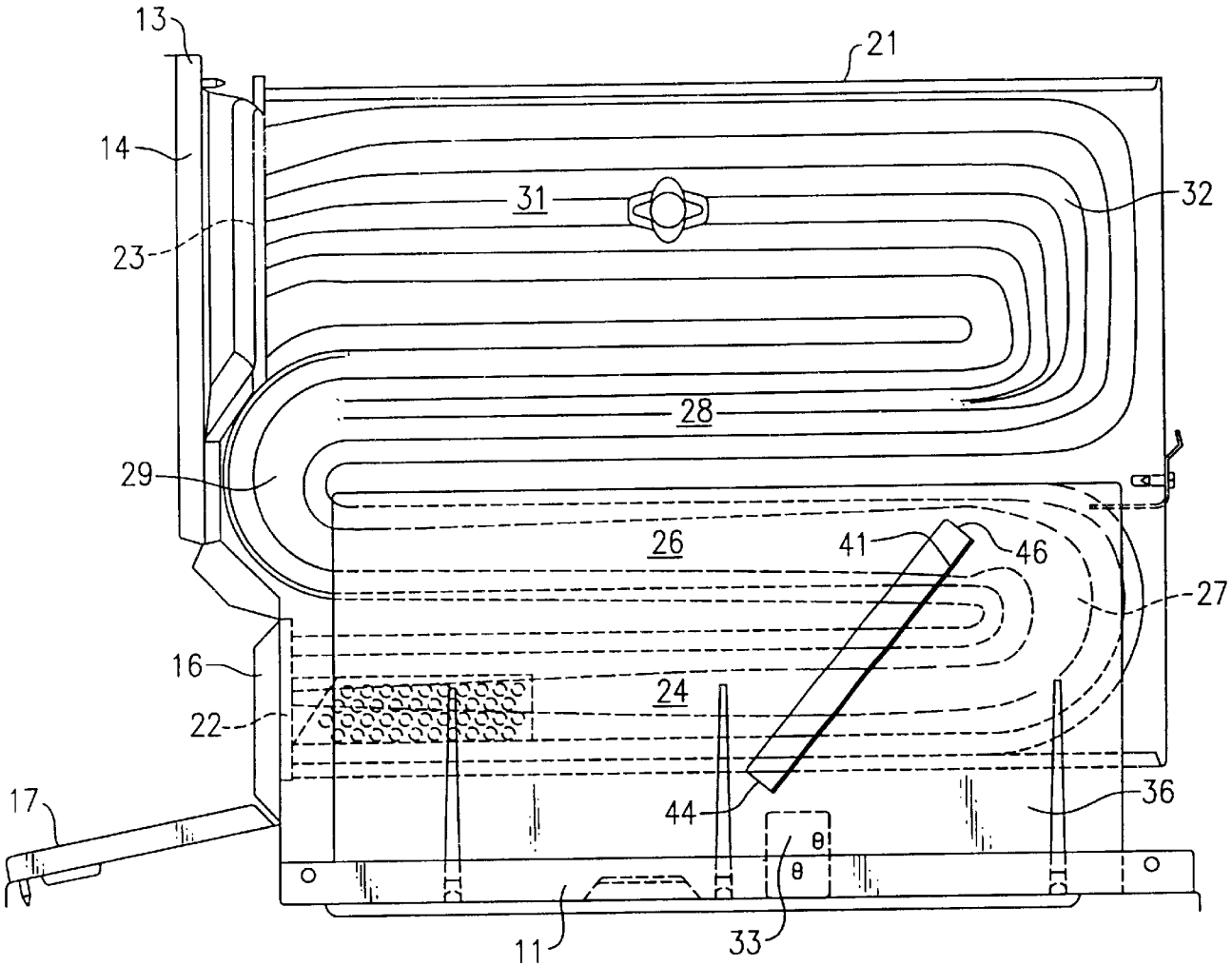
FIG. 3 is a side view of the heat exchanger panel and a diverter vane as installed in a furnace in accordance with the present invention.
Figure 4:
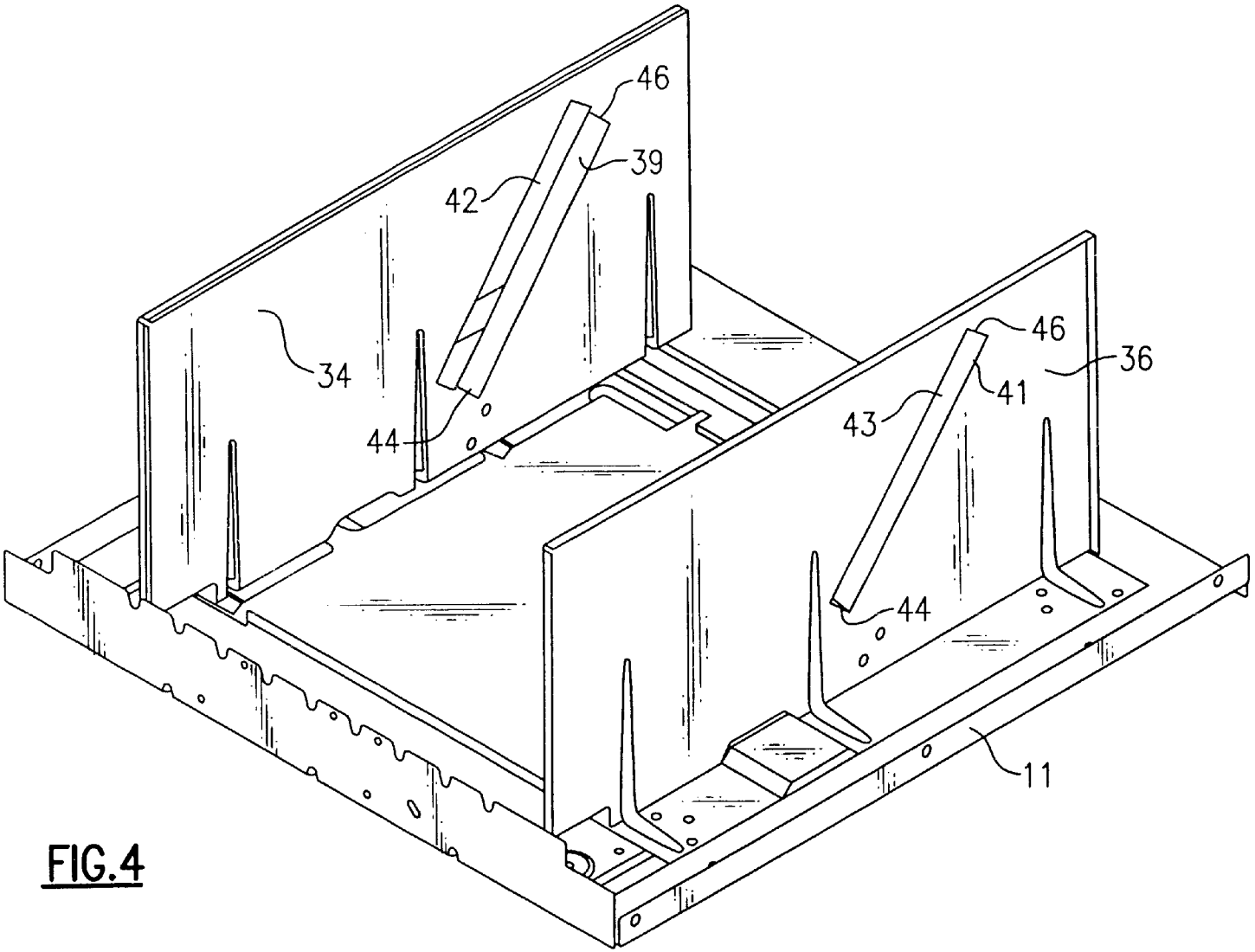
FIG. 4 is a perspective view of a blower shelf, sidewall baffles and diverter vanes as installed in accordance with the present invention.

As will be seen in FIGS. 2 and 3, the heat exchanger panels 21 are of the clamshell type and include multiple serpentine passes that provide a fluidic flow of the hot gases flowing internally therein from its inlet opening 22 to its outlet opening 23. The first pass 24 is fluidly connected to the second pass 26 by a first return bend 27, the second pass 26 is fluidly connected to the third pass 28 by a second return bend 29, and the third pass 28 is fluidly interconnected to the fourth pass 31 by a third return bend 32.

In operation, the hot gases pass from the burners to the inlet openings 22 of the respective heat exchanger panels and progressively pass through the four passes to the outlet openings 23. At the same time, the air to be heated is caused to circulate upwardly by the circulating fan located in the blower compartment. The air passes over the outer surfaces of the heat exchanger panels 21 to be heated, with the hot air then being further circulated by a duct to a space to be heated. This is a conventional operation in the industry, and though the apparatus has been described with some specificity, it may take other forms while remaining within the applicability of the present invention. For example, while the heat exchanger panel has been described as a multipass, clamshell heat exchanger, other types, such as a pipe heat exchanger, may be used. Further, the system has been described in terms of use with an inducer, but it should be understood that the present invention would also be applicable to a furnace without an inducer.

In order to obtain a relatively uniform flow of circulating air over the heat exchanger panels, it has become common practice to include a so-called blower shelf baffle 33 near the leading edge or bottom surface of the heat exchanger panels 21. Such a baffle is generally placed just to one side of the midpoint of the heat exchanger panels 21 and extends laterally across each of the heat exchanger panels and is attached to the blower shelf 11 on either side thereof. The purpose of this baffle is to somewhat straighten (i.e. divert it to a vertical direction) the flow of air coming from the fan with a horizontal component.

Other baffles that are conventionally used include sidewall baffles and rear wall baffles. In the present apparatus, it will be seen in FIGS. 1–4 that the sidewall baffles are shown at 34 and 36, and the rear wall baffle is shown at 37. The sidewall baffles 34 and 36 are mounted on the blower shelf 11 and extend vertically upward in the parallel relationship with, and spaced from, the respective outboard heat exchanger panels. Their purpose is to assist in directing the airflow along the outer surfaces of the outboard heat exchanger panels so as to enhance the heat transfer characteristics thereof. This is desirable because of the tendency of the outboard heat exchanger panels to have a less uniform distribution of airflow over their surfaces as compared with the inboard heat exchanger panels which are centrally located with respect to the airflow stream.

The rear wall baffle 37 has a similar purpose in that it again is positioned on the periphery of the airflow stream in order to provide a more uniform airflow distribution and enhanced heat transfer characteristics in that area. In particular, this baffle 37 is generally placed near the first return bend 27, where hot spots are most likely to a occur. That is, because the hot gases are cooled as the flow proceeds along the various passes, the temperatures are the highest in the first pass. Further, because of the change of direction that occurs at the return bend 27, the point at which hot spots are most likely to occur are at the end of the return bend 27 or the beginning of the second pass 26. Accordingly, the rear wall baffle 37 is placed near this location and includes a plurality of generally horizontally extending baffle plates 38 that are disposed between the respective heat exchanger panels 21 and which tend to direct some of the upflowing circulating air over that area in which the hot spots are most likely to occur. The baffle plates 38 are preferably sized so as to engage the heat exchanger panels 21 on either side thereof so as to serve a second purpose of maintaining proper spacing between adjacent heat exchanger panels 21.

The applicants have found that even with the use of the sidewall baffles 34 and 36, and the rear wall baffle 37, hot spots may still occur. In particular, at the critical location between the first return bend 37 and the second pass 26 of the outboard heat exchanger panels 21, it was found that the existing baffles did not prevent hot spots. Accordingly, a diverter vane was installed near each of the outboard heat exchanger panels 21 to farther enhance the airflow distribution in this area.

The diverter vanes are shown at 39 and 41 in FIGS. 1–4. As will most clearly be seen in FIG. 4, the diverter vanes 39 and 41 are formed by simply making three sided cuts through each of the sidewall baffles 34 and 36 and bending the rectangular shaped diverter vane members 39 and 41 downwardly so that they extend substantially normally from their respective sidewall baffles 34 and 36 and leave the rectangular shaped openings 42 and 43 in the respective sidewall baffles 36 and 37. They extend at an oblique angle to the plane of the heat exchanger passes, with one end 44 being located downwardly near the center of the first pass and the other end 46 being located upwardly near the area where the hot spots are most likely to occur as discussed hereinabove. Preferably, the lower end 44 is located near the blower shelf baffle 33 as shown in FIGS. 1–3 such that the circulation air coming off of the blower shelf baffle 33 will be diverted by the diverter vanes 39 and 41 to channel a substantial portion of the circulatior air to the outer surface of the outboard heat exchanger panels in the critical area between the first return bend 27 and the second pass 26 thereof.

While the irvention has been described with reference to a preferred embodiment, it should be recognized that the invention is not limited to that particular embodiment. Rather, many modifications and variations will present themselves to persons skilled in the art without departing from the true scope and spirit of this invention. For example, although the diverter vanes are shown as being formed from, and integral with, the sidewall baffles, they may be separate pieces which are attached to the sidewall baffles.

What is claimed is:

1. An air baffle diverter vane for a furnace of the type having a plurality of heat exchanger panels aligned in parallel relationship for the transfer of heat from hot gases flowing internally therein to air being circulated over their outer surfaces, at least one of an outboard heat exchanger panel being susceptible to hot spots at a particular location on its surface, comprising:

at least one side baffle mounted within the furnace, in substantial parallel relationship with, and spaced from, said outboard heat exchanger panel for directing the flow of circulated air over a side surface of said panel; and a diverter vane attached to and extending from said side baffle in the direction of said outboard heat exchanger panel for directing a portion of said circulating air over said hotspot location.

2. An air baffle diverter vane as set forth in claim 1 wherein said diverter vane extends substantially normally from said side baffle.

3. An air baffle diverter vane as set forth in claim 1 wherein said diverter vane extends at an oblique angle with respect to said side baffle, with its lower end being located near a midpoint said outboard heat exchanger panel and its upper end being located near said hotspot location.

4. An air baffle diverter vane as set forth in claim 1 wherein said heat exchanger panel is comprised of multiple passes with return bends therebetween.

5. An air baffle diverter vane as set forth in claim 4 wherein said hotspot location is between a first return bend and a second pass.

6. An air baffle diverter vane as set forth in claim 3 and including a blower shelf and a blower shelf baffle disposed below said heat exchanger panel and further wherein said diverter vane lower end is located near said blower shelf baffle.

7. An air baffle diverter vane as set forth in claim 1 wherein said diverter vane forms an integral part of said side baffle.

8. An air baffle diverter vane as set forth in claim 7 wherein said diverter vane comprises a portion of said side baffle which is cut out and bent over at one side thereof.

9. An air diverter vane arrangement for a furnace of the type having a plurality of side-by-side heat exchanger panels over which air is caused to circulate, including at least one outboard panel that is susceptible to hot spots at a particular location thereon, comprising:

a side baffle mounted in the furnace near an outboard side of said at least one outboard heat exchanger panel and extending upwardly in substantially parallel relationship with said heat exchanger panei; and an air diverter vane extending from air inboard surface of said side baffle for diverting a portion of circulation air to cool the hotspot location.

10. An air diverter vane arrangement as set forth in claim 9 wherein said diverter vane extends substantially normally from said side baffle.

11. An air diverter vane arrangement as set forth in claim 9 wherein said diverter vane extends at an oblique angle with respect to said side baffle, with its lower end being located near a midpoint of said outboard heat exchanger panel and its upper end being located near said hotspot location.

12. An air diverter vane arrangement as set forth in claim 9 wherein said heat exchanger panel is comprised of multiple passes with return bends therebetween.

13. An air diverter vane arrangement as set forth in claim 12 wherein said hotspot location is between a first return bend and a second pass.

14. An air diverter vane arrangement as set forth in claim 11 and including a blower shelf and a blower shelf baffle disposed below said heat exchanger panel and further wherein said diverter vane lower end is located near said blower shelf baffle.

15. An air diverter vane arrangement as set forth in claim 9 wherein said diverter vane forms an integral part of said side baffle.

16. An air diverter vane arrangement as set forth in claim 15 wherein said diverter vane comprises a portion of said side baffle which is cut out and bent over at one side thereof.

* * * * *